US010454207B1

(12) United States Patent
Eun

(10) Patent No.: US 10,454,207 B1
(45) Date of Patent: Oct. 22, 2019

(54) PACKING MEMBER FOR WATERPROOF ELECTRIC CONNECTOR

(71) Applicant: Sung Guen Eun, Seoul (KR)

(72) Inventor: Sung Guen Eun, Seoul (KR)

( * ) Notice: Subject to any disclaimer, the term of this patent is extended or adjusted under 35 U.S.C. 154(b) by 0 days.

(21) Appl. No.: 16/153,715

(22) Filed: Oct. 6, 2018

(30) Foreign Application Priority Data

Sep. 17, 2018 (KR) ..... 10-2018-0110768

(51) Int. Cl.

| | |
|---|---|
| ***H01R 13/52*** | (2006.01) |
| ***H01R 43/00*** | (2006.01) |
| ***H01R 13/58*** | (2006.01) |
| ***H01R 13/512*** | (2006.01) |
| *H01R 103/00* | (2006.01) |
| *H01R 24/28* | (2011.01) |
| *H01R 24/20* | (2011.01) |

(52) U.S. Cl.
CPC ..... *H01R 13/5221* (2013.01); *H01R 13/512* (2013.01); *H01R 13/5216* (2013.01); *H01R 13/5812* (2013.01); *H01R 43/005* (2013.01); *H01R 24/20* (2013.01); *H01R 24/28* (2013.01); *H01R 2103/00* (2013.01)

(58) Field of Classification Search
CPC ..... H01R 13/5221; H01R 13/512; H01R 13/5216; H01R 43/005; H01R 24/20; H01R 24/28; H01R 2103/00; H01R 13/5812
USPC ..... 439/270–282, 135
See application file for complete search history.

(56) References Cited

U.S. PATENT DOCUMENTS

| | | | | |
|---|---|---|---|---|
| 4,441,777 | A * | 4/1984 | Harootion | H01R 13/533 439/274 |
| 6,010,348 | A * | 1/2000 | Alden | H01R 13/506 439/274 |
| 7,988,476 | B2 * | 8/2011 | Billman | H01R 13/622 439/271 |
| 9,472,890 | B2 * | 10/2016 | Arai | H01R 13/5205 |
| 2005/0075000 | A1 * | 4/2005 | Wu | H01R 13/5213 439/320 |
| 2006/0172578 | A1 * | 8/2006 | Parsons | H01R 13/5202 439/291 |
| 2013/0309883 | A1 * | 11/2013 | Wolfe | H01R 13/58 439/106 |

FOREIGN PATENT DOCUMENTS

| | | | |
|---|---|---|---|
| KR | 10-2008-0046465 | A | 5/2008 |
| KR | 10-2011-0074832 | A | 7/2011 |
| WO | 2017/034120 | A1 | 3/2017 |

* cited by examiner

*Primary Examiner* — Khiem M Nguyen
(74) *Attorney, Agent, or Firm* — Korus Patent, LLC; Seong Il Jeong

(57) ABSTRACT

A packing member for an electric connector according to the present invention is made of conical silicone. A cut line that is inclined downward to the right from the top of the packing member to the bottom of the packing member, so that the packing member can be conveniently coupled to any portion of an electric wire by spreading the cut line and can be separated from the electric wire when needed. The packing member is coupled to the contact surface of an electric wire entry end, and has no problem with a waterproof function regardless of the cut line.

4 Claims, 10 Drawing Sheets

PACKING MEMBER FOR WATERPROOF ELECTRIC CONNECTOR

BACKGROUND

1. Technical Field

The present invention relates generally to a packing member for a waterproof electric connector, and more specifically to a packing member that has been improved to facilitate assembly and separation for use in conjunction with a waterproof electric connector which can couple a pair of electric connectors in order to prevent them from being separated by external pressure during a process of connecting the pair of electric connectors, which can maintain the watertightness of connected portions, and which can maintain the watertightness of gaps between and the first side ends of the housings of the electric connectors and wires adapted to be passed through the first side ends of the housings and to be connected to connection components provided inside the housings.

2. Description of the Related Art

Generally, various types of electric/electronic equipment or devices are connected to power supply sources through electric connectors (e.g., outlets and plugs), and are supplied with the power required for operation. However, of these electric connectors, the outlets are open at their first ends such that plugs can be inserted thereinto from the outside, and thus various types of impurities may easily infiltrate thereinto from the outside in a state in which the plugs have been inserted thereinto.

In particular, outlets and plugs used in places having a large amount of water or moisture, such as a bathroom, outlets and plugs used for devices using electricity outdoor, such as a vending machine, an aquarium, a game machine, a refrigerator, etc., and outdoor outlets and plugs installed in an outdoor construction site, a shipyard, a submarine fiber-optic cable, a live-fish tank, and a billboard are problematic in that rainwater or moisture infiltrates from the outside to the inside and thus there is considerable concern about the occurrence of a safety-related accident, such as a short circuit or an electric shock.

Furthermore, most conventional plugs and outlets use a coupling method in which each plug is simply inserted into a corresponding outlet. Accordingly, when the outlet and the plug are connected to each other, there frequently occurs a case where contact terminals located inside the outlet are not tightly connected to the terminal pins of the plug. In this case, the plug may be easily separated from the outlet by a small amount of external pressure, with the result that there frequently occurs a problem in which current is cut off and thus electric/electronic equipment or an electric/electronic device is stopped during operation.

In order to overcome the above problems of the conventional electric connectors, numbers of waterproof outlets and plugs, such as those shown in the accompanying FIGS. 1 and 2, have been introduced recently. However, these conventional waterproof outlets and plugs are configured such that the outlets are connected to the plugs in a state in which the plugs are simply surrounded by waterproof caps. These conventional waterproof outlets and plugs have structural defects in that rainwater (including water) or moisture cannot be prevented from infiltrating into a gap between one side end of each plug body and a wire and also in that the waterproofing of a portion where each plug and each outlet are connected, as well as the waterproofing of the outlet itself, is impossible.

Prior art documents regarding the above-described waterproof electric connectors are as follows:

Document 1: Korean Patent Application Publication No. 10-2008-0046465 (Waterproof Plug; filed on Nov. 22, 2006);

Document 2: Korean Patent No. 10-1219019 (Waterproof Plug and Outlet Structure; filed on May 23, 2011); and Document 3: International Publication No. WO 2017-034120 A1 (Waterproof Electric Connector; filed on Apr. 26, 2016)

SUMMARY

The present invention has been conceived to overcome the above-described problems, and an object of the present invention is to provide a waterproof electric connector which can couple a pair of electric connectors in order to prevent them from being separated by external pressure during a process of connecting the pair of electric connectors, which can maintain the watertightness of connected portions, and which can maintain the watertightness of gaps between the first side ends of the housings of the electric connectors and wires adapted to be passed through the first side ends of the housings and to be connected to connection components provided inside the housings.

Another object of the present invention is to provide a packing member for an electric connector, in which a cut line is formed in the packing member, so that the packing member can be conveniently coupled to and separated from an electric wire while securing watertightness.

In order to accomplish the above objects, the present invention provides a waterproof electric connector including: first and second connectors configured such that first and second wire entry ends whose inner circumferences narrow in inward directions are respectively provided at the first side ends of first and second housings accommodating first and second connection components, respectively; packing members including first and second packings configured to be inserted into the inner circumferences of the first and second wire entry ends in a surface contact manner and to maintain watertightness; first and second finishing caps formed as blocking components which are coupled to the outer circumferences of the first and second wire entry ends in order to guide first and second wires into the first and second housings, and configured to press the first and second packings in a direction toward surfaces along which the inner circumferences of the first and second wire entry ends come into contact with the first and second wires through the pressing of the first side surfaces of the first and second packings during a process of being coupled to the first and second wire entry ends; a coupling cap configured such that in a state in which one side end thereof has been fitted over the outer circumference of the first wire entry end, the other side end thereof is coupled to the outer circumference of one side end of the second housing which is connected to the first housing; and a connection packing part including, among portions where the first and second housings are coupled to each other by the coupling cap, a first elastic packing configured to be provided in a portion where the coupling cap and the front end of the second housing come into contact with each other and to maintain watertightness, and a second elastic packing configured to be provided in a portion where the inner circumferential surface of the second housing comes into contact with the outer circumferential surface of the first housing and to maintain watertightness; wherein a cut line is formed through the outer surface of each of the first and second packings to be helically inclined right from the top of each of the first and second packings having a smaller diameter to the bottom of each of the first and second packings having a larger diameter so that each of the first and second packings is spread and opened based on the cut line and exposes the inside thereof including a center through hole, and is formed over a length corresponding to at least 1.5 turns around each of the first and second packings.

Furthermore, the present invention provides a packing member for a waterproof electric connector, wherein the packing member is made of elastic silicone and formed in a conical shape having a smaller top diameter and having a larger bottom diameter, a cut line is formed through the outer surface of the packing member to be helically inclined to the right from the top of the packing member having a smaller diameter to the bottom of the packing member having a larger diameter so that the packing member is spread and opened based on the cut line and exposes the inside thereof, and is formed over a length corresponding to at least 1.5 turns around the packing member, and a center through hole is formed to accommodate an electric wire that passes through the electric connector.

Furthermore, the present invention provides a method of fabricating the packing member, the method including: preparing a molded product made of silicone, which is a raw material of the packing member; fastening the molded product to a rotating frame; and forming an inclined cut line in the molded product by vertically moving a cutting machine or cutter while rotating the rotating frame at a predetermined rotation speed.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

The present invention will be described in detail with reference to the accompanying drawings presented as described above, as follows:

A waterproof electric connector 100 according to the present invention is based on International Application No. PCT/KR2016/004324, which is a preceding application of the present applicant and which is hereby incorporated therein by reference.

Figure 1:
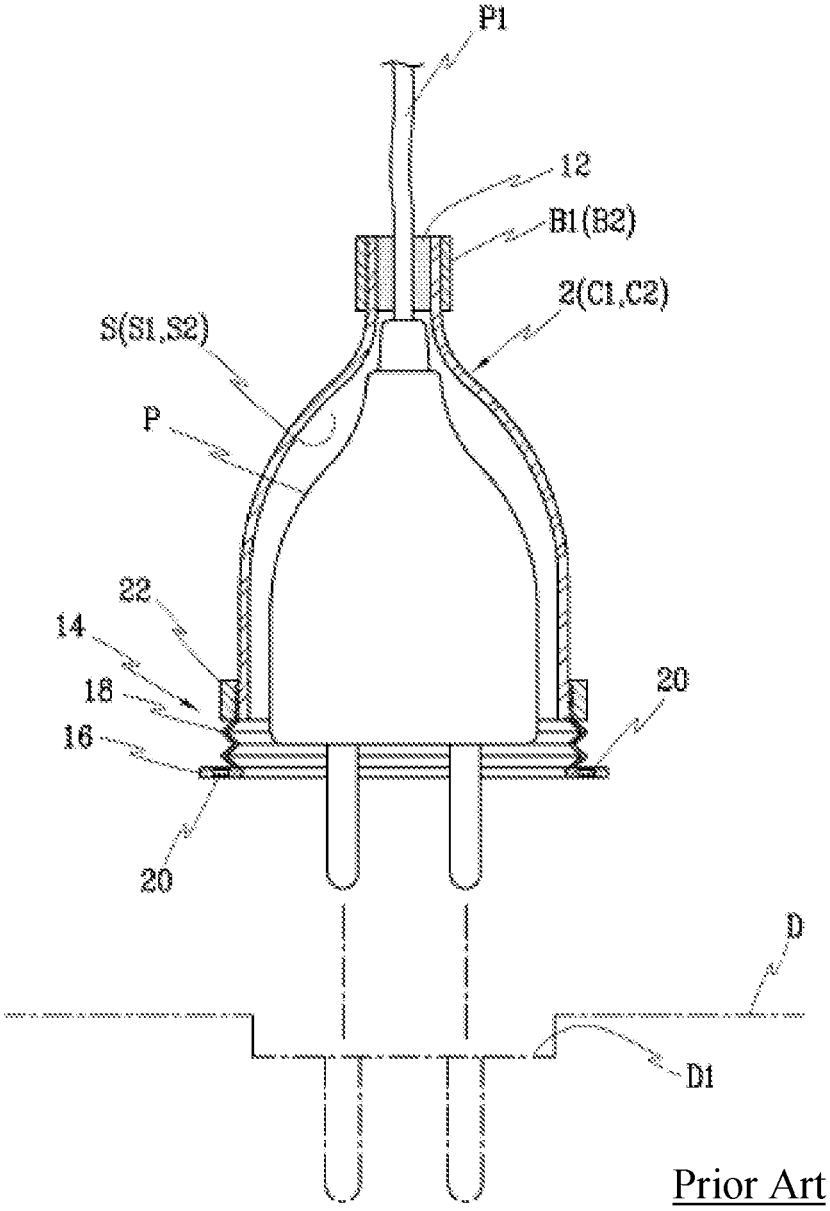
FIG. 1 is a diagram showing the configuration and structure of a conventional waterproof plug.
Figure 2:
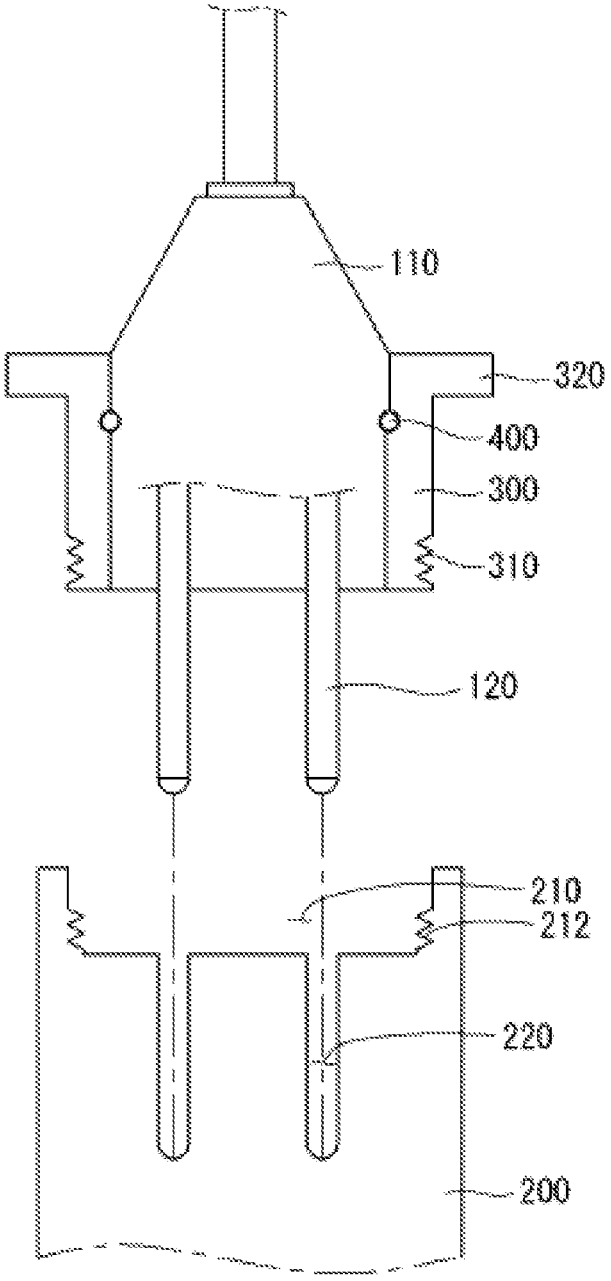
Prior Art FIG. 2
FIG. 2 is a diagram showing the configuration and structure of a conventional waterproof plug and outlet structure.
Figure 3:
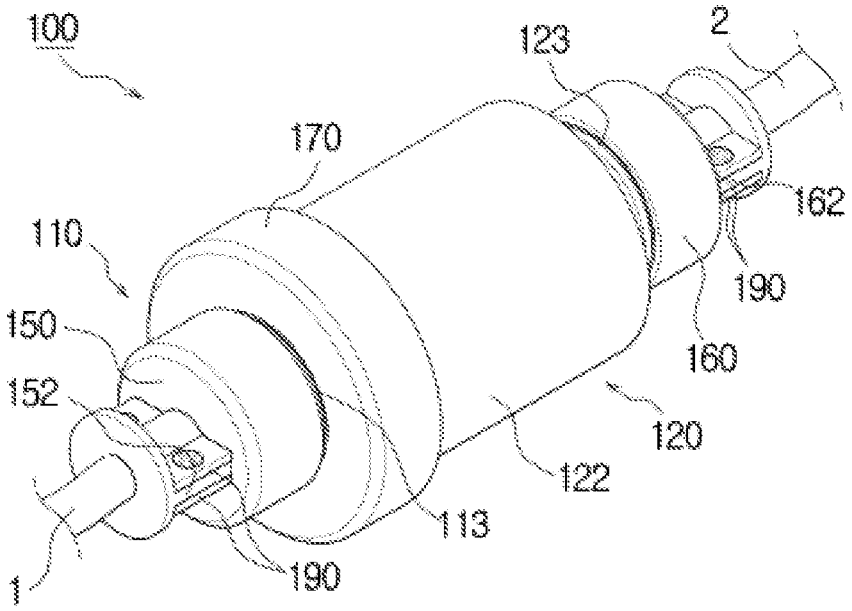
FIG. 3 is a perspective view showing a configuration according to an embodiment of the present invention.
Figure 4:
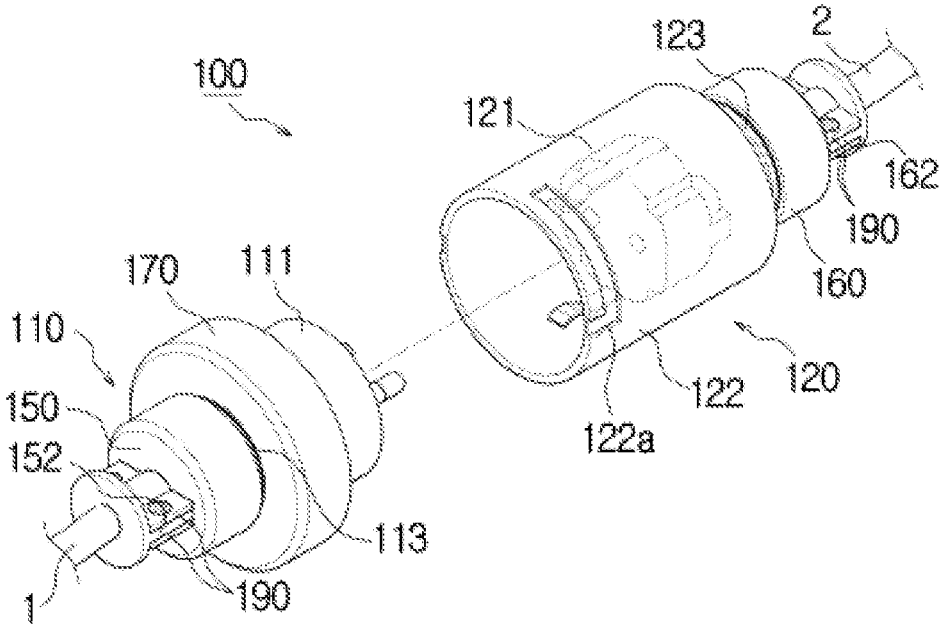
FIG. 4 is a perspective view showing the separated configuration according to the embodiment of the present invention.
Figure 5:
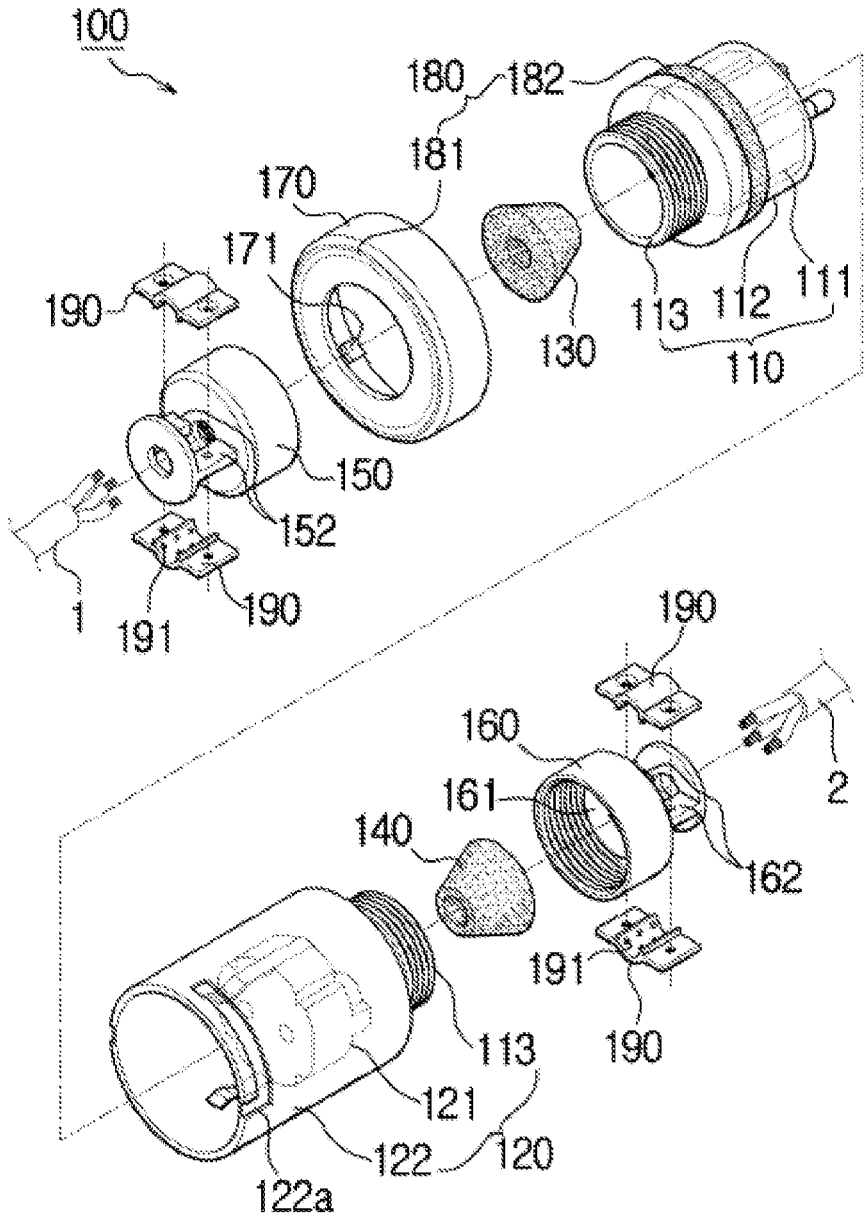
FIG. 5 is a perspective view showing the separated configuration according to the embodiment of the present invention in greater detail.

As shown in FIGS. 3 to 5, the waterproof electric connector 100 according to the present invention may be configured to include: first and second connectors 110 and 120 configured such that first and second wire entry ends 113 and 123 whose inner circumferences narrow in inward directions are respectively provided at the first side ends of first and second housings 112 and 122 accommodating first and second connection components 111 and 121, respectively; first and second packings 130 and 140 configured to be inserted into the inner circumferences of the first and second wire entry ends 113 and 123 in a surface contact manner and to maintain watertightness; first and second finishing caps 150 and 160 formed as blocking components which are coupled to the outer circumferences of the first and second wire entry ends 113 and 123 in order to guide first and second wires 1 and 2 into the first and second housings 112 and 1220, and configured such that first and second pressing members 151 and 161 configured to press the first and second packings 130 and 140 against surfaces along which the inner circumferences of the first and second wire entry ends 113 and 123 come into contact with the first and second wires 1 and 2 are provided on portions of the inner sides of the front ends of the first and second finishing caps 150 and 160 corresponding to the first sides of the first and second packings 130 and 140; a coupling cap 170 configured such that in a state in which one side end thereof has been fitted over the outer circumference of the first wire entry end 113, the other side end thereof is coupled to the outer circumference of one side end of the second housing 122 which is connected to the first housing 112; and a connection packing part 180 including, among portions where the first and second housings 112 and 122 are coupled to each other by the coupling cap 170, a first elastic packing 181 configured to be provided in a portion where the coupling cap 170 and the front end of the second housing 122 come into contact with each other and to maintain watertightness, and a second elastic packing 182 configured to be provided in a portion where the inner circumferential surface of the second housing 122 comes into contact with the outer circumferential surface of the first housing 112 and to maintain watertightness.

In this case, in the present invention, the first connection component 111 may be an electric plug or electric connector, and the second connection component 121 may be an electric outlet or electric connector.

In this case, the first connection component 111, i.e., an electric plug or connector, may be a finished product (formed in an integrated manner through injection molding) in which the first wire 1 and connectors (terminals) have been assembled together in advance, or may be a half-finished product in which the first wire 1 will be screwed into connectors (terminals).

Furthermore, the second connection component 121, i.e., an electric outlet or electric connector, may be a finished product (formed in an integrated manner through injection molding) in which the second wire 2 and connectors (terminals) have been assembled together in advance, or may be a half-finished product in which the second wire 2 is screwed into connectors (terminals).

Meanwhile, in the present invention, the first housing 112 may be a synthetic resin or rubber case configured to accommodate the first connection component 111, and the second housing 122 may be a synthetic resin or rubber case configured to accommodate the second connection component 121.

In this case, a ring-shaped protrusion may be formed on the outer circumferential surface of one side end of the first housing 112, and the second elastic packing 182 of the connection packing part 180 may be fitted over the ring-shaped protrusion. Alternatively, a ring-shaped depression may be formed through the outer circumferential surface of one side end of the first housing 112, and the second elastic packing 182 of the connection packing part 180 may be fitted into the ring-shaped depression.

Figure 6:
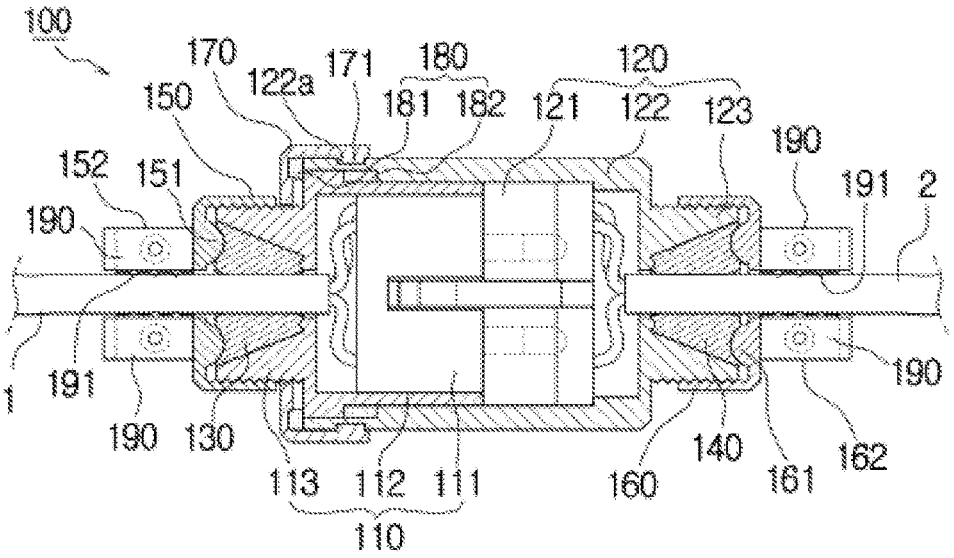
FIG. 6 is a sectional view showing the combined configuration according to the embodiment of the present invention in greater detail.
Figure 7:
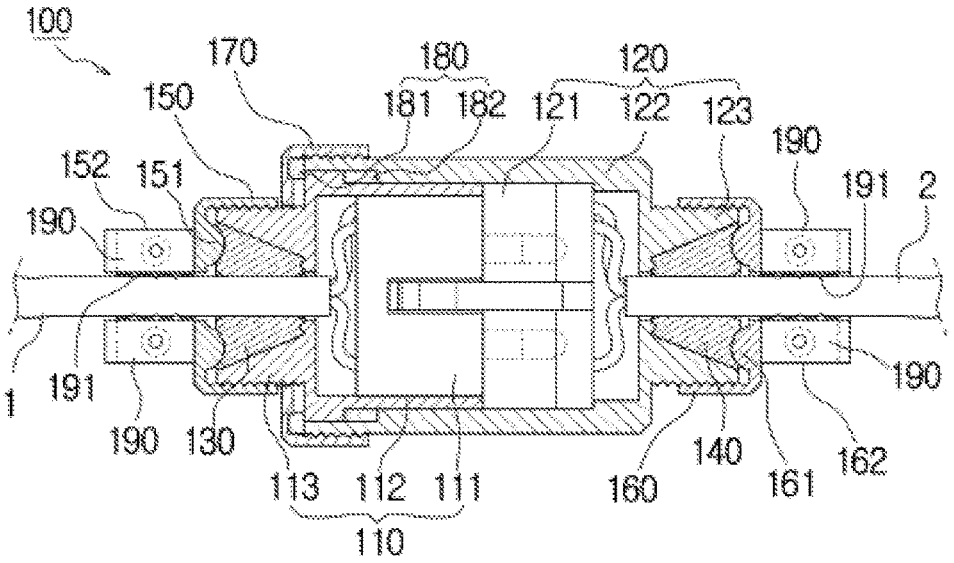
FIG. 7 is a sectional view showing another combined configuration according to an embodiment of the present invention in greater detail.

Furthermore, as shown in the accompanying FIG. 6, an "L"-shaped coupling depression 122*a* may be formed through the outer circumferential surface of the second housing 122 onto which the coupling cap 170 is coupled, and may be engaged with the "L"-shaped coupling depression 122*a* through rotation in a state in which a coupling protrusion 171 provided on the inner circumferential surface of the coupling cap 170 has been fitted thereinto. Alternatively, as shown in the accompanying FIG. 7, screw threads may be formed through the outer circumferential surface of the second housing 122 onto which the coupling cap 170 is coupled, and may be engaged with screw threads provided through the inner circumferential surface of the coupling cap 170 through rotation.

Meanwhile, in the present invention, the inner circumference of the first wire entry end 113 forms a central hollow shape in which the diameter of the front end thereof is large and the diameter thereof decreases in an inward direction. A ring-shaped pressing protrusion may be formed on the inner hollow surface of the first wire entry end 113, and screw threads configured to be engaged with the first finishing cap 150 may be formed on the outer circumferential surface of the first wire entry end 113.

Meanwhile, in the present invention, the inner circumference of the second wire entry end 123 forms a central hollow shape in which the diameter of the front end thereof is large and the diameter thereof decreases in an inward direction. A ring-shaped pressing protrusion may be formed on the inner hollow surface of the first wire entry end 113, and screw threads configured to be engaged with the second finishing cap 160 may be formed on the outer circumferential surface of the first wire entry end 113.

Meanwhile, in the present invention, the first finishing cap 150 may be a cover configured such that the center thereof is formed to be hollow and screw threads are formed on the inner circumferential surface thereof so that the cover is coupled to the first wire entry end 113 through engagement. Ribs 152 configured to provide surfaces for the coupling of wire movement prevention means 190 may be formed on both sides around a center through hole on the outside of the front end of the first finishing cap 150.

Furthermore, the first pressing member 151 provided on the surface portion of the first finishing cap 150 which is in contact with the first packing 130 may be a ring-shaped protrusion.

Meanwhile, in the present invention, the second finishing cap 160 may be a cover configured such that the center thereof is formed to be hollow and screw threads are formed on the inner circumferential surface thereof so that the cover is coupled to the second wire entry end 123 through engagement. Ribs 162 configured to provide surfaces for the coupling of the wire movement prevention means 190 may be formed on both sides around a center through hole on the outside of the front end of the second finishing cap 160.

Furthermore, the second pressing member 161 provided on the surface portion of the second finishing cap 160 in contact with the second packing 161 may be a ring-shaped protrusion.

In this case, the pair of wire movement prevention means 190 composed of symmetrical wire pressing members separated into both sides may be provided on the ribs 152 or 162 of each of the first and second finishing caps 150 and 160. In other words, the pair of wire movement prevention means 190 formed to be symmetrical and configured to fasten the first or second wire 1 or 2, exposed between the ribs 152 or 162, to the ribs 152 or 162 of the first or second finishing cap 150 or 160 while pressing the first or second wire 1 or 2 may be provided on the ribs 152 or 162 provided on both sides around the through hole on the outside of the front end of the first or second finishing cap 150 or 160.

In this case, wedge-shaped stoppers 191 configured to prevent movement may be provided on the curved surfaces of the wire movement prevention means 190 which are in contact with the wires.

Meanwhile, in the present invention, the coupling cap 170 may be a cover configured such that the center thereof is formed to be hollow and a coupling protrusion 171 or screw threads configured to be engaged with the coupling depression 122*a* or screw threads of the second housing 122 are formed on the inner circumferential surface thereof. The hollow center portion may be inserted over the first wire entry end 113, and the coupling cap 170 may be prevented from being separated by the first finishing cap 150 which is engaged with the first wire entry end 113.

Meanwhile, in the present invention, the connection packing part 180 may include: the first elastic packing 181 configured to be provided in a ring shape on the inner surface of the coupling cap 170 within the portion where the front end of the second housing and the coupling cap 170 come into contact with each other; and the second elastic packing 182 configured to be provided in a portion formed through the outer circumferential surface of the first housing 112 within the portion where the first housing 112 and the second housing 122 come into contact with each other.

The operation of the embodiment of the present invention configured as described above will be described, as follows:

First, according to the present invention, the first connection component 111, i.e., a plug, is inserted into one side of the first housing 112 so that plug terminals are exposed to the outside, and the first wire 1 (three strands of wire including a ground wire) is passed through the centers of the first finishing cap 150, the first packing 130, the coupling cap 170, and the first housing 112 (via through holes) and is connected to the first connection component 111 inserted into the first housing 112.

After this, when the first packing 130 is inserted into the inner circumference of the first wire entry end 113 of the first housing 112 and the first finishing cap 150 is coupled to the outer circumference of the first wire entry end 113, the first pressing member 151 of the first finishing cap 150 brings the first packing 130 into tight contact with the inner circumference and inside end of the first wire entry end 113 while pressing the first packing 130. In this case, the front end of the coupling cap 170 is located in the state in which the separation thereof is prevented between the first housing 112 and the first finishing cap 150.

Thereafter, the second connection component 121, i.e., an outlet, is inserted into one side of the second housing 122, and the second wire 2 (three strands of wire including a ground wire) is passed through the centers of the first finishing cap 160, the second packing 140, and the second housing 112 (via through holes) and is connected to the second connection component 121 inserted into the second housing 122.

After this, when the second packing 140 is inserted into the inner circumference of the second wire entry end 123 of the second housing 122 and the second finishing cap 160 is coupled to the outer circumference of the second wire entry end 123, the second pressing member 161 of the second finishing cap 160 brings the second packing 140 into tight contact with the inner circumference and inside end of the second wire entry end 123 while pressing the second packing 140.

Thereafter, the first connection component 111 and the second connection component 121 are electrically connected to each other by inserting the front end of the first housing 112 accommodating the first connection component 111 into the inner circumference of the second housing 122.

When the first connection component 111 and the second connection component 121 have been connected as described above, the other side end of the coupling cap 170 whose one side end is caught on the first housing 112 of the first connector 110 is located to correspond to the outer circumferential surface of the second housing 122 of the second connector 120, and then the coupling between the first housing 111 and the second housing 122 is allowed to be securely maintained by rotating the coupling cap 170.

Figure 8:
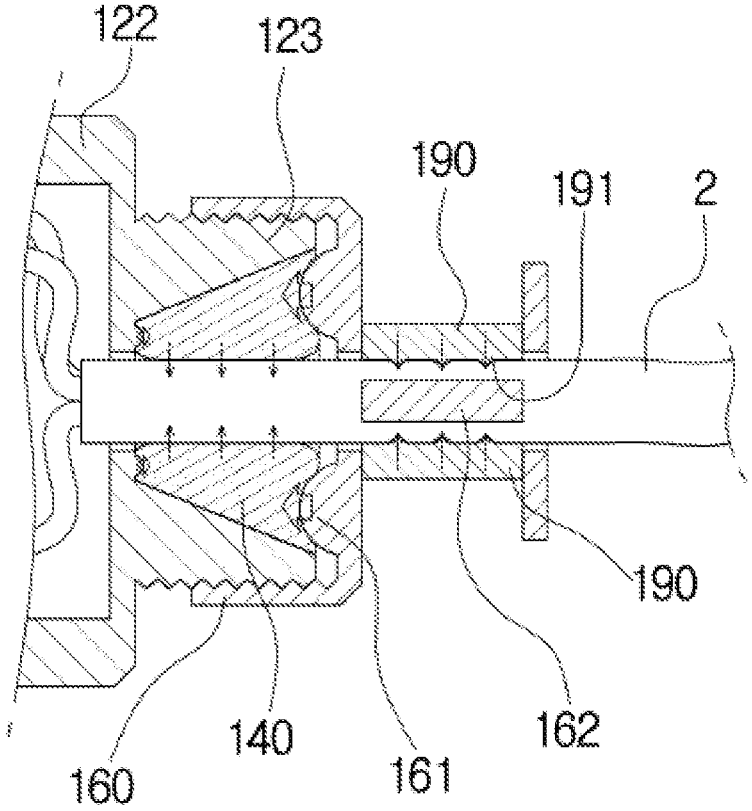
FIG. 8 is a partially sectional view showing the operation of the present invention.

According to the present invention as described above, as shown in FIG. 8, in a state in which the first and second packings 130 and 140 have been inserted into the inwardly narrowing inner circumferences of the first and second wire entry ends 113 and 123 provided on the first side ends of the first and second housings 112 and 122, respectively, the first and second finishing caps 150 and 160 are coupled to the outer circumferences of the first and second wire entry ends 113 and 123. Accordingly, the first and second pressing members 151 and 161 provided on the first and second finishing caps 150 and 160 press the first and second packings 130 and 140 onto the surfaces where the inner circumferences of the first and second wire entry ends 113 and 123 and the first and second wires 1 and 2 come into contact with each other. As a result, water can be prevented from infiltrating into gaps between the first and second wire entry ends 113 and 123 of the first and second housings 112 and 122 and the first and second packings 130 and 140, and also water can be prevented from infiltrating into gaps between the first and second packings 130 and 140 and the first and second wires 1 and 2, in a dual manner.

Furthermore, according to the present invention, in a state in which one side end of the coupling cap 170 has been inserted into the outer circumference of the first wire entry end 113, the other side end thereof is coupled to the outer circumference of one side end of the second housing 122 connected to the first housing 112, and the connection packing part 180 (the first and second elastic packings 181 and 182) is provided in the corresponding portions of the coupling cap 170 and the first housing 112 which come into contact with the front end and outer circumferential surface of the second housing 122 accordingly. Accordingly, the first connector 110 and the second connector 120 are made to remain connected. As a result, the connection between the first connector 110 and the second connector 120 can be prevented from being released by external pressure, and also water can be prevented from infiltrating into a gap between the connection portions of the first connector 110 and the second connector 120, in a dual manner, thereby maintaining watertightness.

Moreover, according to the present invention, the pair of ribs 152 or 162 are symmetrically provided on both sides around the through hole on the outside of the front end of each of the first and second finishing caps 150 and 160. When the pair of wire movement prevention means 190 are screwed into the ribs 152 or 162 with the ribs 152 or 162 interposed therebetween, the opposite surfaces of the wire movement prevention means 190 or the stoppers 191 provided on the opposite surfaces press the wires. As a result, the connection of the first and second wires 1 and 2 connected to the first and second connection components can be prevented from being easily released by external pressure.

In this case, when the wire movement prevention means 190 have elasticity and are coupled to the front ends of the first and second finishing caps 150 and 160, water can be prevented from infiltrating into gaps between the first and second finishing caps 150 and 160 and the first and second wires 1 and 2.

Figure 9:
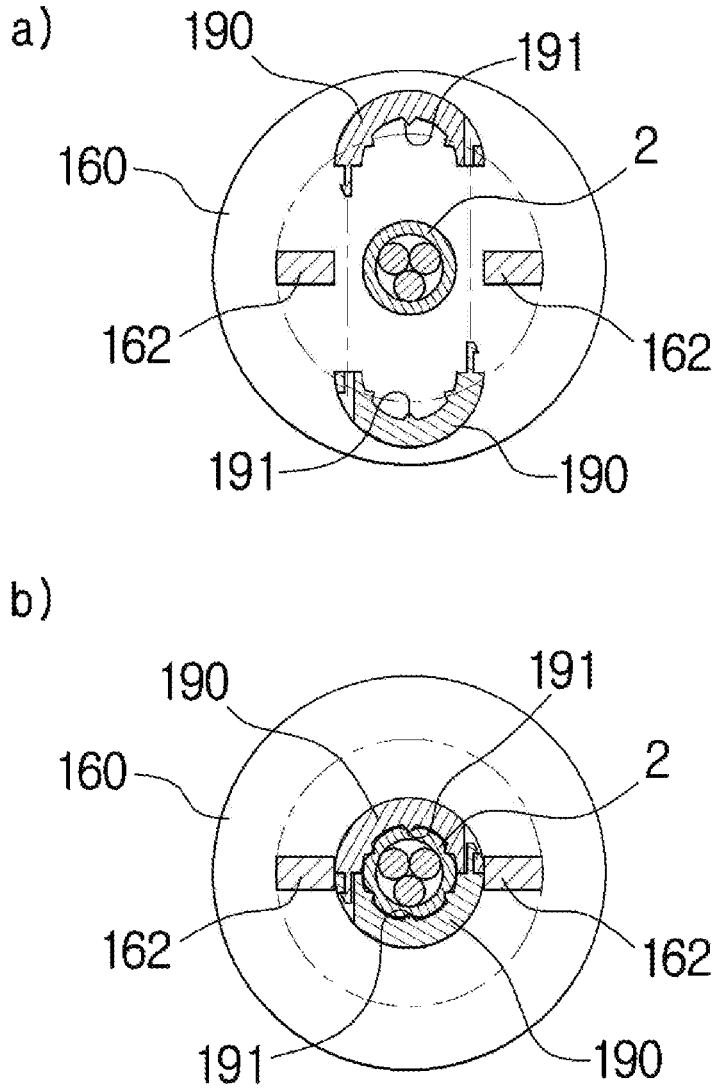
FIG. 9 is a sectional view showing another configuration of a wire movement prevention means in the present invention.

In the above-described present invention, as shown in a) and b) of FIG. 9, the pair of wire movement prevention means 190 are provided, and depressions and coupling protrusions are provided on the wire movement prevention means 190. Through the engagement of the depressions and the coupling protrusions, the opposite surfaces of the wire movement prevention means 190 or stoppers 191 provided on the opposite surfaces are allowed to press the wires. As a result, the connection of the first and second wires 1 and 2 connected to the first and second connection components can be prevented from being easily released by external pressure.

<First and Second Packings of Second Embodiment>

Next, first and second packings 130 and 140 according to a second embodiment of the present invention will be described. Since the first and second packings 130 and 140 are of a conical type and have the same structure, the following description will be given with a focus on the first packing 130, but the same description will be also applied to the second packing 140.

Figure 10:
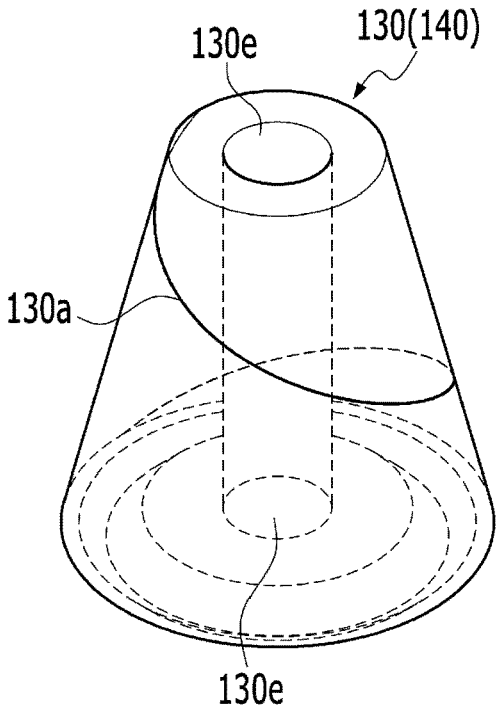
FIG. 10 a perspective view of a first packing according to a second embodiment of the present invention.

As shown in FIG. 10, a cut line **130*a* is formed through the outer surface of the first packing 130. The first packing 130 may be spread and opened based on the cut line 130*a*, and may expose the inside thereof including the center through hole 130*e*. The cut line 130*a* is formed to be helically inclined from the top of the first packing 130 having a smaller diameter to the bottom of the first packing 130 having a larger diameter. The cut line 130*a* is preferably formed throughout the overall height of the first packing 130 from the top thereof to the bottom thereof. Since the first packing 130 is pressed against the inclined inner surface of the first wire entry end 113 by rotating the first packing 130 to the right and thus moving the first packing 130 forward, it is preferred that the cut line 130*a* starts from an upper left location, is inclined toward a lower right location, and then ends. This can prevent the cut line 130*a* from being gradually spread and opened by frictional force and also prevent the forward movement of the first packing 130 from being obstructed by the cut line 130***a* when the first packing 130 is rotated into and pressed against the first wire entry end 113.

Furthermore, the cut line 130*a* is preferably formed over a length corresponding to at least 1.5 turns around the first packing 130. When the cut line 130*a* is formed over a length shorter than a length corresponding to 1.5 turns, the inclination of the cut line 130*a* is reduced and the cut line 130*a* becomes similar to a rectilinear line, and thus a disadvantage arises in that the cut line 130*a* is easily opened by frictional force and also a watertight effect provided by the first packing 130 is reduced when the first packing 130 is rotated into and pressed against the first wire entry end 113.

Figure 11:
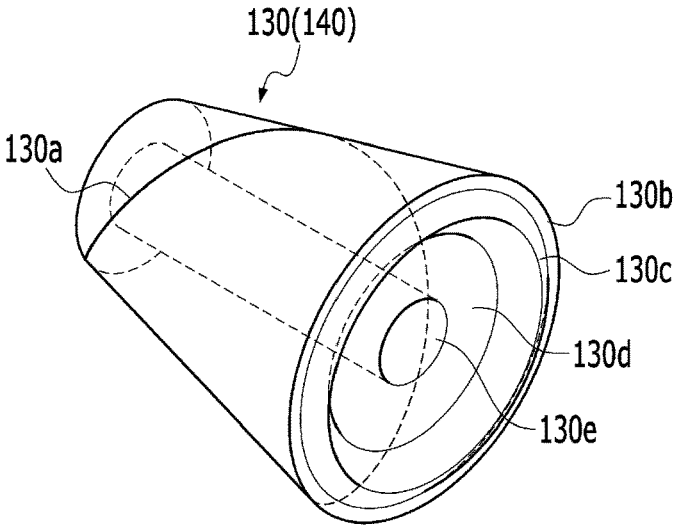
FIG. 11 is a perspective view showing the back surface of the first packing shown in FIG. 10.

FIG. 11 is a perspective view showing the back surface of the first packing 130 according to the second embodiment of the present invention. The back surface of the first packing 130 includes an annular periphery 130*b*, a ring-shaped rib 130*c* configured to protrude backward, and a support surface 130*d* configured such that the center through hole 130*e* is formed in the center thereof sequentially from the outside of the back surface of the first packing 130. Although the first pressing member 151 is formed to protrude toward the back surface of the first packing 130 in FIGS. 6 and 7, the first pressing member 151 needs to be formed in a concave shape in order to accommodate the rib 130*c* of the first packing 130 due to the above-described structure of the back surface. However, it should be noted that this structure is one of various embodiments of the back surface and the back surface may vary depending on a change in structure in various manners.

Figure 12:
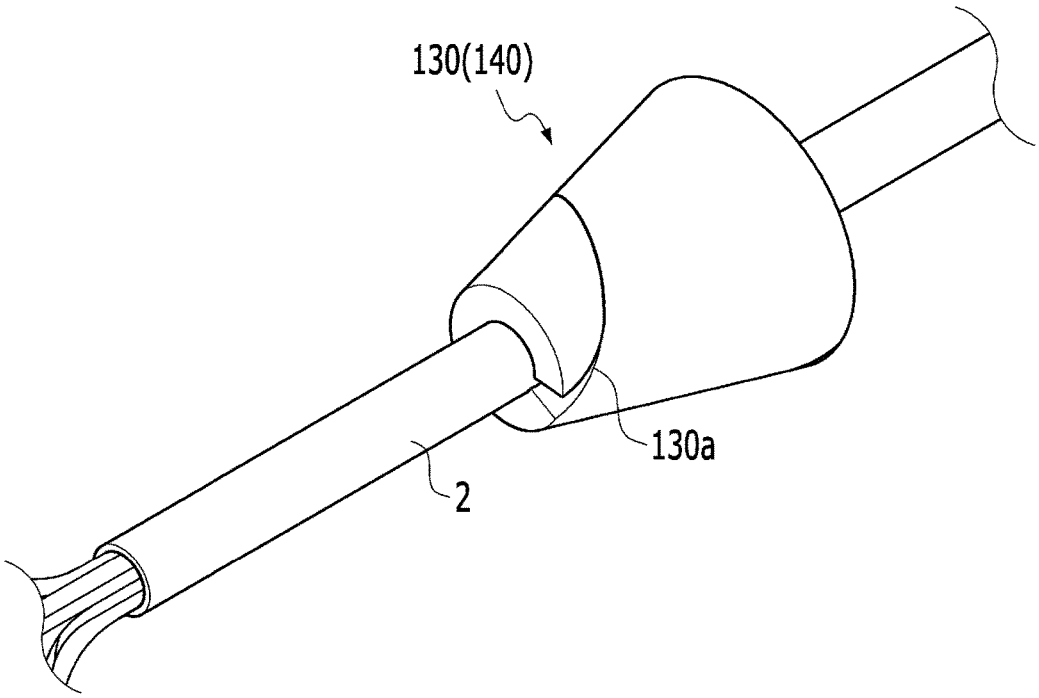
FIG. 12 is a view showing a state in which the first packing according to the second embodiment of the present invention has been coupled to and is used in conjunction with an electric wire.

FIG. 12 shows an example of the use of the first packing 130 according to the second embodiment of the present invention. Generally, in order to insert the first packing 130 over the first wire 1, the first packing 130 is inserted from an end of the first wire 1 and is then moved forward by pulling it. Since the first packing 130 needs to maintain a watertight structure by pressing the first wire 1 after coupling, a tight pressing relationship is established from the step of being inserted over the first wire 1. In contrast, according to the second embodiment of the present invention, when the first packing 130 is spread and opened by means of the cut line 130*a* of the first packing 130 based on the cut line 130*a*, the first wire 1 is placed on the center through hole 130*a* and then the cut line 130*a* is released, the first packing 130 is returned to its original shape and restores a tight pressing relationship with the first wire 1. Accordingly, the first packing 130 may be moved close to and fastened to any portion of the first wire 1 and may be separated from the portion of the first wire 1 when needed, and thus the insertion and separation of an electric wire is significantly facilitated. Furthermore, it was verified through various experiments that when the shape and length of the cutting line 130*a* were maintained as described above, the cutting line 130*a* was not spread and kept in a closed state during a process of coupling with the first wire entry end 113, and thus the watertight structure was not weakened and water did not leak due to the cutting line 130*a*.

Figure 13:
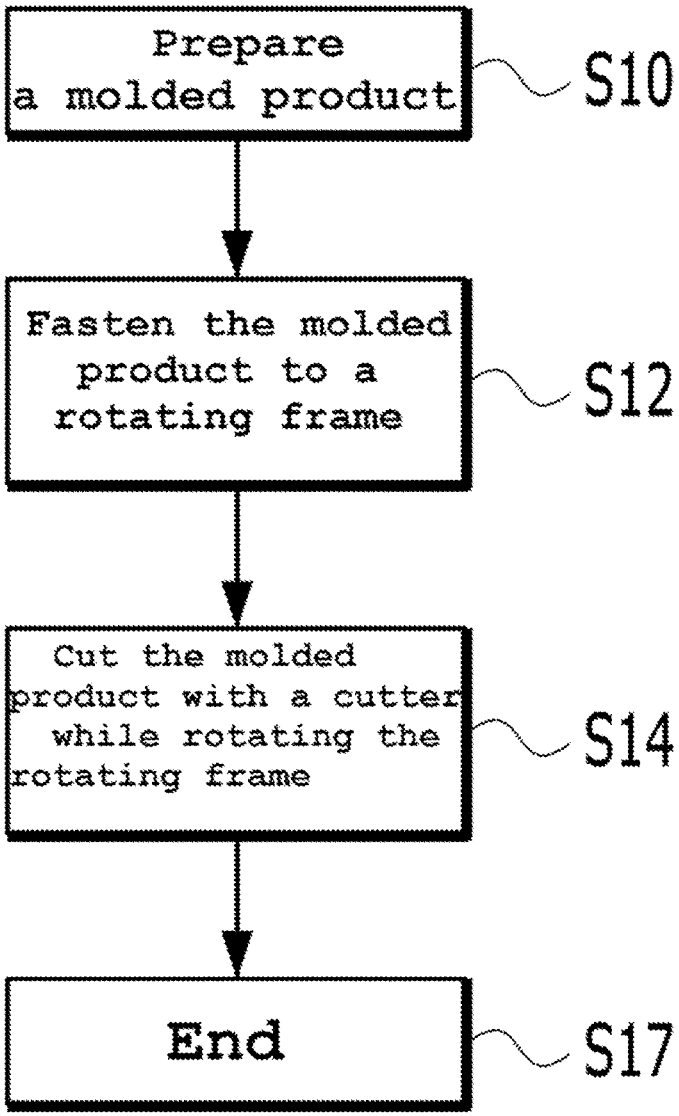
FIG. 13 is a block diagram showing a method of fabricating the first packing according to the second embodiment of the present invention.

FIG. 13 shows an example of a process of forming the cut line 130*a* in the first packing 130 according to an embodiment of the present invention. First, a worker prepares a molded product made of silicone, which is the raw material of the first packing 130, at step S10. The molded product is fabricated through injection molding. Thereafter, the molded product for a packing is fastened to a rotating frame at step S12. The inclined cut line 130*a* is formed in the molded product by vertically moving a cutting machine or cutter while rotating the rotating frame at a predetermined rotation speed, thereby completing the first packing 130. Alternatively, at steps S12 and S14, the molded product may be fastened, and the cut line 130*a* may be formed by moving a cutter downward along a predetermined curve trajectory.

According to the present invention based on the above-described technical solution, in a state in which the first and second packings 130 and 140 have been inserted into the inwardly narrowing inner circumferences of the first and second wire entry ends 113 and 123 provided on the first side ends of the first and second housings 112 and 122, respectively, the first and second finishing caps 150 and 160 are coupled to the outer circumferences of the first and second wire entry ends 113 and 123. Accordingly, the first and second pressing members 151 and 161 provided on the first and second finishing caps 150 and 160 press the first and second packings 130 and 140 against the surfaces where the inner circumferences of the first and second wire entry ends 113 and 123 and the first and second wires 1 and 2 come into contact with each other. As a result, the present invention is advantageous in that water can be prevented from infiltrating into gaps between the first and second wire entry ends 113 and 123 of the first and second housings 112 and 122 and the first and second packings 130 and 140 and in that water can be prevented from infiltrating into gaps between the first and second packings 130 and 140 and the first and second wires 1 and 2, in a dual manner.

Furthermore, according to the present invention, in a state in which one side end of the coupling cap 170 has been inserted into the outer circumference of the first wire entry end 113, the other side end thereof is coupled to the outer circumference of one side end of the second housing 122 connected to the first housing 112, and the connection packing part 180, i.e., the first and second elastic packings 181 and 182, are provided in the corresponding portions of the coupling cap 170 and the first housing 112 which come into contact with the front end and outer circumferential surface of the second housing 122 accordingly. Accordingly, the first connector 110 and the second connector 120 are made to remain connected. As a result, the present invention is advantageous in that the connection between the first connector 110 and the second connector 120 can be prevented from being released by external pressure and water can be prevented from infiltrating into a gap between the connection portions of the first connector 110 and the second connector 120, in a dual manner, and in that watertightness can be maintained.

Furthermore, according to the present invention, the pair of wire movement prevention means 190 formed to be symmetrical and configured to fasten each of the first and second wires 1 and 2 exposed between the ribs 152 and 162 of the first or second finishing cap 150 or 160 while pressing the first or second wire 1 or 2 are provided on the ribs 152 and 162 provided on both sides around the through hole on the outside of the front end of each of the first and second finishing gaps 150 and 160. As a result, the present invention is advantageous in that the connection of the first and second wires 1 and 2 passed through the first and second finishing gaps 150 and 160 and the first and second wire entry ends 113 and 123 of the first and second housings 112 and 122 and connected to the first and second connection components can be prevented from being easily released by external pressure. In this case, when the wire movement prevention means 190 have elasticity and are coupled to the front ends of the first and second finishing caps 150 and 160, water can be prevented from infiltrating into gaps between the first and second finishing caps 150 and 160 and the first and second wires 1 and 2.

Moreover, the present invention is advantageous in that each of the first and second packings may be moved close to and fastened to any portion of a wire and may be separated from the portion of the wire when needed, so that the insertion and separation of an electric wire are significantly facilitated.

The packing members including the first and second packings according to the present invention are versatile in that they can be applied to an electric connector according to a specific embodiment and can be also widely applied without a change in structure as packings for electric connectors that are used to connect electric wires and wire entry ends to each other.

Although the present invention has been described and illustrated in connection with the preferred embodiments intended to illustrate the principle of the present invention, the present invention is not limited to the configurations and operations which are illustrated and described above.

Rather, it will be readily understood by a person skilled in the art that a plurality of variations and modifications may be made to the present invention without departing from the spirit and scope of the claims.

Therefore, all appropriate variations, modifications, and equivalents should be viewed as falling within the scope of the present invention.

What is claimed is:

1. A waterproof electric connector comprising:

first and second connectors configured such that first and second wire entry ends whose inner circumferences narrow in inward directions are respectively provided at first side ends of first and second housings accommodating first and second connection components, respectively; packing members including first and second packings configured to be inserted into the inner circumferences of the first and second wire entry ends in a surface contact manner and to maintain watertightness; first and second finishing caps formed as blocking components which are coupled to outer circumferences of the first and second wire entry ends in order to guide first and second wires into the first and second housings, and configured to press the first and second packings in a direction toward surfaces along which the inner circumferences of the first and second wire entry ends come into contact with the first and second wires through pressing of first side surfaces of the first and second packings during a process of being coupled to the first and second wire entry ends; a coupling cap configured such that in a state in which one side end thereof has been fitted over the outer circumference of the first wire entry end, a remaining side end thereof is coupled to an outer circumference of one side end of the second housing which is connected to the first housing; and a connection packing part including, among portions where the first and second housings are coupled to each other by the coupling cap, a first elastic packing configured to be provided in a portion where the coupling cap and a front end of the second housing come into contact with each other and to maintain watertightness, and a second elastic packing configured to be provided in a portion where an inner circumferential surface of the second housing comes into contact with an outer circumferential surface of the first housing and to maintain watertightness;

wherein a cut line is formed through an outer surface of each of the first and second packings to be helically inclined right from a top of each of the first and second packings having a smaller diameter to a bottom of each of the first and second packings having a larger diameter so that each of the first and second packings is spread and opened based on the cut line and exposes an inside thereof including a center through hole, and is formed over a length corresponding to at least 1.5 turns around each of the first and second packings.

2. The waterproof electric connector of claim 1, wherein a back surface of each of the first and second packings includes an annular periphery, a ring-shaped rib configured to protrude backward, and a support surface configured such that a center through hole is formed in a center thereof sequentially from an outside of the back surface.

3. A packing member for a waterproof electric connector, wherein the packing member is made of elastic silicone and formed in a conical shape having a smaller top diameter and having a larger bottom diameter, a cut line is formed through an outer surface of the packing member to be helically inclined right from a top of the packing member having a smaller diameter to a bottom of the packing member having a larger diameter so that the packing member is spread and opened based on the cut line and exposes an inside thereof, and is formed over a length corresponding to at least 1.5 turns around the packing member, and a center through hole is formed to accommodate an electric wire that passes through the electric connector.

4. A method of fabricating the packing member of claim 3, the method comprising:

preparing a molded product made of silicone, which is a raw material of the packing member;

fastening the molded product to a rotating frame; and forming an inclined cut line in the molded product by vertically moving a cutting machine or cutter while rotating the rotating frame at a predetermined rotation speed.

* * * * *